US012473508B2

(12) United States Patent
Saccomando et al.

(10) Patent No.: US 12,473,508 B2
(45) Date of Patent: Nov. 18, 2025

(54) FRICTION MODIFIERS WITH IMPROVED FRICTIONAL PROPERTIES AND LUBRICATING COMPOSITIONS CONTAINING THE SAME

(71) Applicant: The Lubrizol Corporation, Wickliffe, OH (US)

(72) Inventors: Daniel J. Saccomando, Sheffield (GB); William R.S. Barton, Belper (GB); Charlotte Ellen Roy, Rothwell (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/683,970

(22) PCT Filed: Aug. 18, 2022

(86) PCT No.: PCT/US2022/040716

§ 371 (c)(1),
(2) Date: Feb. 15, 2024

(87) PCT Pub. No.: WO2023/023224

PCT Pub. Date: Feb. 23, 2023

(65) Prior Publication Data

US 2024/0352372 A1 Oct. 24, 2024

Related U.S. Application Data

(60) Provisional application No. 63/234,852, filed on Aug. 19, 2021.

(51) Int. Cl.

| | |
|---|---|
| ***C10M 129/42*** | (2006.01) |
| ***C10M 139/00*** | (2006.01) |
| *C10N 10/04* | (2006.01) |
| *C10N 40/25* | (2006.01) |

(52) U.S. Cl.

CPC ..... *C10M 129/42* (2013.01); *C10M 139/00* (2013.01); *C10M 2207/282* (2013.01); *C10M 2227/09* (2013.01); *C10N 2010/04* (2013.01); *C10N 2040/25* (2013.01)

(58) Field of Classification Search

CPC ..... C10M 129/42; C10M 139/00; C10M 2207/282; C10M 2227/09; C10M 2207/04; C10M 2207/044; C10M 2207/262; C10M 2209/105; C10M 2215/064; C10M 2219/022; C10M 2219/046; C10M 2223/045; C10M 129/76; C10M 129/74; C10M 2207/283; C10M 2207/289; C10M 2215/28; C10N 2010/04; C10N 2040/25; C10N 2030/52; C10N 2030/02; C10N 2030/06; C10N 2030/10; C10N 2030/40; C10N 2030/43; C10N 2030/54

USPC ..... 508/371

See application file for complete search history.

(56) References Cited

U.S. PATENT DOCUMENTS

| | | | | |
|---|---|---|---|---|
| 3,172,892 | A | 3/1965 | Le Suer et al. | |
| 4,234,435 | A | 11/1980 | Meinhardt et al. | |
| 4,863,623 | A | 9/1989 | Nalesnik | |
| 6,107,257 | A | 8/2000 | Valcho et al. | |
| 6,107,258 | A | 8/2000 | Esche, Jr. et al. | |
| 6,117,825 | A | 9/2000 | Liu et al. | |
| 7,285,516 | B2 | 10/2007 | Carrick et al. | |
| 7,407,919 | B2 | 8/2008 | Wilk et al. | |
| 7,615,521 | B2 | 11/2009 | Eveland et al. | |
| 8,067,347 | B2 | 11/2011 | Ruhe, Jr. et al. | |
| 2005/0038319 | A1 | 2/2005 | Goldwasser et al. | |
| 2005/0065045 | A1 | 3/2005 | Wilk et al. | |
| 2005/0075254 | A1* | 4/2005 | Pollock | C10M 129/74 508/501 |
| 2010/0197536 | A1 | 8/2010 | Mosier et al. | |
| 2010/0298185 | A1 | 11/2010 | Gieselman et al. | |
| 2011/0306528 | A1 | 12/2011 | Gieselman et al. | |
| 2015/0291912 | A1* | 10/2015 | Bergen-Brenkman | C11C 3/12 554/163 |
| 2017/0247629 | A1 | 8/2017 | Ng et al. | |

FOREIGN PATENT DOCUMENTS

| | | | |
|---|---|---|---|
| EP | 0355895 | B1 | 12/1994 |
| FR | 2908422 | A1 | 5/2008 |
| WO | 2006015130 | A1 | 2/2006 |
| WO | 2006047486 | A1 | 5/2006 |
| WO | WO2008059155 | A1 | 5/2008 |
| WO | 2008124191 | A1 | 10/2008 |
| WO | 20080147704 | A1 | 12/2008 |

* cited by examiner

*Primary Examiner* — Prem C Singh
*Assistant Examiner* — Francis C Campanell
(74) *Attorney, Agent, or Firm* — Michael A. Miller

(57) ABSTRACT

The instant disclosure relates to lubricating compositions having improved frictional properties. The lubricating compositions include an oil of lubricating viscosity and a friction modifier that is a $C_{10}$ to $C_{14}$ alkenyl carboxylic acid ester of an aliphatic diol or polyol, where the double bond of the alkenyl group is within or directly attached to the longest continuous chain of the alkenyl group.

7 Claims, No Drawings

FRICTION MODIFIERS WITH IMPROVED FRICTIONAL PROPERTIES AND LUBRICATING COMPOSITIONS CONTAINING THE SAME

CROSS REFERENCE TO RELATED APPLICATION

This application claims priority from PCT Application Serial No. PCT/US2022/023224 filed on Aug. 18, 2022, which claims the benefit of U.S. Provisional Application No. 63/234,852 filed on Aug. 19, 2021, both of which are incorporated in their entirety by reference herein.

FIELD

The instant disclosure relates to lubricating compositions having improved frictional properties.

BACKGROUND

Friction modifiers for use in lubricant compositions are well known. Glycerol monooleate ("GMO") has been used as a friction modifier in lubricants for decades. However, GMO tends to hydrolyze over time and lose effectiveness due to its weak ester bond. The detriment of GMO can impact its frictional performance and as a result negatively affect fuel economy in an engine due to friction modifiers aiding in overcoming energy loss through friction.

Additionally, it is recognised that the act of heat and formation of acid during normal use of an internal combustion engine can cause additives such as friction modifiers like GMO to degrade, thus reducing its longevity, rendering them ineffective at reducing friction. One aspect of this invention is that the superior friction reduction of the $C_{10}$ to $C_{14}$ alkenyl carboxylic acid ester of an aliphatic diol or polyol can be delivered (by slow release) at a time when conventional solutions would have perished as a function of degradative chemical reactions. Thus, there is a need for a friction modifier that at least can address this deficiency of GMO.

SUMMARY

The instant disclosure relates to lubricating compositions having an oil of lubricating viscosity and a friction modifier that is a $C_{10}$ to $C_{14}$ alkenyl carboxylic acid ester of an aliphatic diol or polyol, where the double bond of the alkenyl group is within or directly attached to the longest continuous chain of the alkenyl group. Lubricating compositions of the instant disclosure may include a friction modifier including one or more of the following structures:

(III)

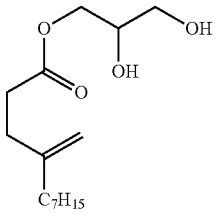

and

-continued (IV)

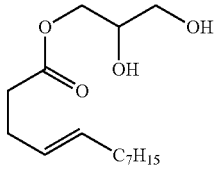

The lubricating compositions may further include one or more lubricant additives selected from polyisobutenyl succinimide dispersants, overbased and neutral detergents, antioxidants, anti-wear agents, friction modifiers, corrosion inhibitors, polymeric viscosity modifiers, foam inhibitors and combinations thereof.

The instant disclosure provides lubricating compositions having a protected ketal precursor compound of Formula V:

(V)

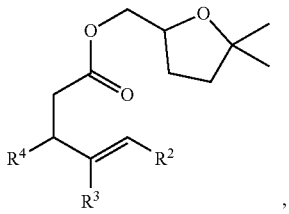

where $R^2$, $R^3$ and $R^4$ are each independently hydrogen or a hydrocarbyl group of 1 to 10 carbon atoms; such that $R^2$, $R^3$ and $R^4$ taken together have from 6 to 10 carbon atoms.

The instant disclosure provides lubricating compositions having a protected ketal precursor compound of Formula VI:

(VI)

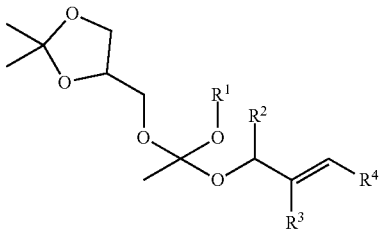

where $R^1$ can is a hydrocarbyl group of 1 to 10 carbon atoms and $R^2$, $R^3$ and $R^4$ are each independently hydrogen or a hydrocarbyl group of 1 to 10 carbon atoms; such that $R^2$, $R^3$, and $R^4$ taken together have from 6 to 10 carbon atoms.

The instant disclosure further relates to methods of operating an internal combustion engine comprising supplying to the engine a lubricating composition of the instant disclosure. Further, the instant disclosure relates to use of the lubricating compositions described herein to perform one or more in an internal combustion engine: reduce friction, improve fuel economy, and reduce wear.

DETAILED DESCRIPTION

The instant disclosure relates to lubricating compositions having an oil of lubricating viscosity and a friction modifier that is a $C_{10}$ to $C_{14}$ alkenyl carboxylic acid ester of an aliphatic diol or polyol, where the double bond of the alkenyl group is within or directly attached to the longest continuous chain of the alkenyl group.

Additionally, this disclosure relates to lubricating compositions where the $C_{10}$ to $C_{14}$ alkenyl carboxylic acid ester of an aliphatic diol or polyol, is formed in situ within the lubricating composition. This is achieved by the use of precursors such as ketal protected derivatives of $C_{10}$ to $C_{14}$ alkenyl carboxylic acid ester of an aliphatic diol or polyol or by the use of orthoesters that contain at least a ketal(s) of an aliphatic diol or polyol alongside an alcohol that is an allylic alcohol where the allylic group contains at least 6 carbon atoms.

In the case of the ketals and orthoesters, it is the action of heat and/or acidity generated by an engine that drives the conversion firstly of the orthoester to the ketal protected ester (of an alkenyl acid and aliphatic diol or polyol) via Johnson-Claisen rearrangement (driven by heat). Then the conversion/deprotection of this ketal (driven by acidity) to the $C_{10}$ to $C_{14}$ alkenyl carboxylic acid ester of an aliphatic diol or polyol.

This generalised reaction can deliver reduced friction in the final product when at least the following three criteria are met: at least one alcohol of the ortho ester is an allylic alcohol derived group, the allylic group contains 10 carbons, at least one other alcohol of the ortho ester is a protected 2,3 diol.

The lubricating composition may include further lubricant additives as set forth herein.

Oils of Lubricating Viscosity

One component of the disclosed compositions is an oil of lubricating viscosity. As used herein, an oil of lubricating viscosity may include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). The cited portions of both references are incorporated herein. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Suitable oils may be produced from biological, i.e. natural, sources or by bio-engineered processes. This includes both natural occurring oils, such as vegetable oils and triglyceride oils that may be further refined or purified by standard processes, and those oils that may be derived by biological conversion of a natural chemical into oil directly or by bio-formation of building block pre-cursor molecules capable of being further converted into oil by known processes.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10), which are incorporated herein by reference.

In one embodiment the oil of lubricating viscosity may be an API Group I to IV mineral oil, an ester or a synthetic oil, or mixtures thereof. In one embodiment, the oil of lubricating viscosity may be an API Group II, Group III, Group IV mineral oil, an ester or a synthetic oil, or mixtures thereof.

The amount of the oil of lubricating viscosity present is typically the balance remaining after subtracting from 100 wt % the sum of the amount of the dispersant additive package according to the instant disclosure and additional, if any, additives.

In the present disclosure, the oil of lubricating viscosity may have a kinematic viscosity measured at 100° C. of 2.4 $m^2/s$ to 6.4 $m^2/s$. In some embodiments, the kinematic viscosity is from 4.0 $m^2/s$ to 5.0 $m^2/s$ or from 5.2 $m^2/s$ to 5.8 $m^2/s$ or from 6.0 $m^2/s$ to 6.5 $m^2/s$. In other embodiments, the kinematic viscosity is 6.2 $m^2/s$ or 5.6 $m^2/s$ or 4.6 $m^2/s$.

The lubricating composition claimed herein may be in the form of a concentrate and/or a fully formulated lubricant. If the lubricating composition is in the form of a concentrate (which may be combined with additional oil to form, in whole or in part, a finished lubricant), the ratio of the components disclosed herein to the oil of lubricating viscosity and/or to diluent oil include the ranges of 1:99 to 99:1 by weight, or 80:20 to 10:90 by weight.

Friction Modifier

The lubricating compositions disclosed herein further include a friction modifier. The friction modifier is an additive that typically reduce the coefficient of dynamic friction under the conditions found in an engine crankcase or valve train. These conditions include sliding and impact of metal parts.

The friction modifier according to the present disclosure is a $C_{10}$ to $C_{14}$ alkenyl carboxylic acid ester of an aliphatic diol or polyol, where double bond of the alkenyl group is between carbons of the longest continuous chain of the alkenyl group or is directly attached to carbon within the longest continuous chain of the alkenyl group.

The alkenyl group herein refers to the hydrocarbyl group attached to the carbonyl of the carboxylic acid used in preparing the friction modifier described herein. The alkenyl is a hydrocarbyl group having at least one double bond. In one embodiment, the alkenyl moiety has a single double bond. In another embodiment, the double bond is between carbons within the longest continuous chain extending from the carbonyl of the carboxylic acid ester. In another embodiment, the double bond is attached to a carbon within the longest continuous chain of the alkenyl group as a pendent moiety. In some embodiments, the double bond of the alkenyl group is attached to a carbon within 3 to 5, or 2 to 4 carbons of the carbonyl of the carboxylic acid ester. In one embodiment, the alkenyl moiety is a hydrocarbon, i.e., comprised of hydrogen and carbon.

The alkenyl group can be linear or branched. The linear or branched nature of the alkenyl group will depend on the starting carboxylic acid. In one embodiment, the alkenyl group is linear. In another embodiment, the alkenyl group is branched. The carboxylic acid containing the alkenyl group useful for preparing the carboxylic acid ester friction modifier disclosed herein can be a $C_8$ to $C_{14}$ alkenyl carboxylic acid. In another embodiment, the carboxylic acid is a $C_{10}$ to $C_{14}$ alkenyl carboxylic acid. In another embodiment, the carboxylic acid is a $C_{10}$ to $C_{12}$ alkenyl carboxylic acid. Suitable carboxylic acids useful for preparing the friction modifier may be selected from one or more of 4-methyleneundecanoic acid and (E)-dodec-4-enoic acid.

In preparing the carboxylic acid ester friction modifier disclosed herein, the carboxylic acid is reacted with an aliphatic diol or polyol. In one embodiment, the carboxylic acid ester friction modifier is prepared with a diol. In another embodiment, the carboxylic acid ester is prepared with a polyol. In one embodiment, the polyol may include 3 to 5 hydroxyl groups. In another embodiment, the polyol may have 3 to 4 hydroxyl groups. In yet another embodiment, the polyol has 3 hydroxyl groups. Suitable diols for use in preparing the carboxylic acid ester include ethylene glycol, propylene glycol, 1,3-propanediol, and combinations thereof. Suitable polyols for use in preparing the carboxylic acid ester include glycerol, trimethylolpropane (TMP), pentaerythritol, sorbitol, xylitol, and combinations thereof. In one embodiment, the polyol is glycerol.

In one embodiment, the alkenyl carboxylic acid ester is a mono-ester of the aliphatic diol or polyol. In another embodiment, the carboxylic acid ester contains a plurality of ester groups of the aliphatic diol or polyol, such as a di-ester or tri-ester. In one embodiment, the carboxylic acid ester has at least two free hydroxyl group originating from the aliphatic diol or polyol. In one embodiment, the alkenyl carboxylic acid ester is a mono-ester of glycerol.

In some embodiments, the alkenyl carboxylic acid ester of the aliphatic diol or polyol is represented by formula I.

(I)

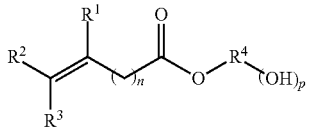

Where:

n=1 to 5;

$R^1$, $R^2$ and $R^3$ are each independently hydrogen or a hydrocarbyl group of 1 to 10 carbon atoms; such that $R^1$, $R^2$, and $R^3$ taken together are from 6 to 12 carbon atoms; and $R^4$ is a linear or branched aliphatic hydrocarbyl of 1 to 12 carbon atoms; and p is an integer from 1 to 4.

In one embodiment, $R^4$ of Formula I is a linear or branched aliphatic hydrocarbyl of 3 to 5 carbon atoms and p is 2.

In another embodiment, the alkenyl carboxylic acid ester of the aliphatic diol or polyol is represented by formula II:

(II)

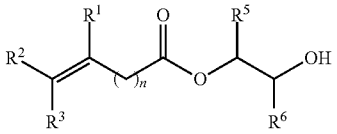

Where:

n=1 to 5;

$R^1$, $R^2$ and $R^3$ are each independently hydrogen or a hydrocarbyl group of 1 to 10 carbon atoms; such that $R^1$, $R^2$, and $R^3$ taken together provide at least 6 carbon atoms and more than 10 carbon atoms to the composition; and $R^5$ and $R^6$ are independently hydrogen or $CH_2OH$ where at least one of $R^5$ and $R^6$ is $CH_2OH$.

In one embodiment, the compound of formula II can further be represented where n is 2, $R^1$ is a $R^1$ is a $C_6$ to $C_{10}$ hydrocarbyl, and $R^2$ and $R^3$ are each hydrogen. In another embodiment of formula II, n is 2, $R^1$ is H, and $R^2$ and $R^3$ are each independently hydrogen or a $C_6$ to $C_{10}$ hydrocarbyl, provided that at least one of R2 or R3 is hydrogen and the other is a $C_6$ to $C_{10}$ hydrocarbyl.

The disclosed compound contains at least one double bond. It is understood that α,β-substituted olefins compounds may exist in a trans-configuration (A), a cis-configuration (B), or mixtures of both isomers (Figure A).

(A)

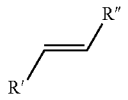

Trans (B)

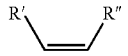

Cis

In one embodiment the alkenyl carboxylic acid ester of an aliphatic diol contains at least 50 mol %, at least 75 mol %, at least 90 mol %, or at least 95 mol % trans double bond. In one embodiment the alkenyl carboxylic acid ester consists of a trans double bond.

In one embodiment, the alkenyl carboxylic acid ester of an aliphatic diol or polyol is represented by the formula (III):

(III)

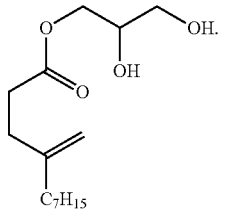

In another embodiment, the alkenyl carboxylic acid ester of an aliphatic diol or polyol is represented by the formula (IV):

(IV)

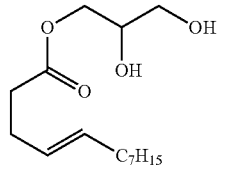

The alkenyl carboxylic acid ester of a diol or polyol as described above may be included in a lubricant composition in an amount of from 0.05 wt % to 1.0 wt %. In some embodiments, the alkenyl carboxylic acid ester of a diol or polyol is present in the lubricant composition in an amount of from 0.7 wt % to 0.75 wt %. In other embodiments, the alkenyl carboxylic acid ester of a diol or polyol is present in the lubricant composition in an amount of from 0.1 wt % to 0.3 wt % or 0.1 wt % to 0.2 wt %.

The alkenyl carboxylic acid ester of a diol or polyol as described above may also be considered in two further embodiments. Firstly, the result of an acidity driven deprotection of a ketal precursor such as the structure below. These precursors may be added to a lubricating composition with the intention of slowly releasing an alkenyl carboxylic acid ester of a diol or polyol driven by the conditions of the engine. These will have the generalized structure of:

(V)

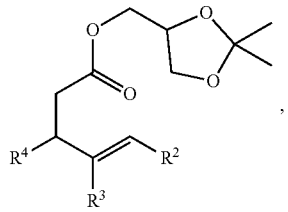

where:

$R^2$, $R^3$ and $R^4$ are each independently hydrogen or a hydrocarbyl group of 1 to 10 carbon atoms; such that $R^2$, $R^3$ and $R^4$ taken together have from 6 to 10 carbon atoms.

As such, lubricating compositions that contain these materials will slowly convert to structures that are alkenyl carboxylic acid ester of a diol or polyols disclosed herein.

Secondly, the ketal precursors such as the structure above may be formed by the 3,3-sigmatropic rearrangement of an orthoester, undergoing the orthoester Johnson-Claisen rearrangement. This is described by the structure below:

(VI)

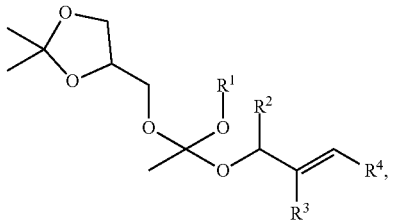

where:

$R^1$ can is a hydrocarbyl group of 1 to 10 carbon atoms, $R^2$, $R^3$ and $R^4$ are each independently hydrogen or a hydrocarbyl group of 1 to 10 carbon atoms; such that $R^2$, $R^3$, and $R^4$ taken together have from 6 to 10 carbon atoms.

This method of forming (and adding to a lubricating composition) the ketal protected precursor of an alkenyl carboxylic acid ester friction modifier provides another chemical pathway to slowly release a friction modifier that is a C10 to C14 alkenyl carboxylic acid ester of an aliphatic diol or polyol, where the double bond of the alkenyl group is within or directly attached to the longest continuous chain of the alkenyl group.

Additionally, this method of forming the orthoester containing both an allylic alcohol and a ketal protected diol of an aliphatic diol or polyol provides another chemical pathway to slowly release a friction modifier that is a C10 to C14 alkenyl carboxylic acid ester of an aliphatic diol or polyol, where the double bond of the alkenyl group is within or directly attached to the longest continuous chain of the alkenyl group In addition to the alkenyl carboxylic acid ester friction modifier described above, lubricating compositions or fully-formulated lubricating oils may further include one or more of a polyisobutenyl succinimide dispersant, an overbased and neutral detergent, an antioxidant, an anti-wear agent, a friction modifier, a corrosion inhibitor, a polymeric viscosity modifier, a foam inhibitor and combinations thereof. Typically, fully-formulated lubricating oils will contain one or more of these performance additives, and often a package of multiple performance additives.

Dispersant:

The lubricating composition of the instant disclosure may further include a dispersant. In one embodiment, the dispersant is a polyalkenyl succinimide dispersant. Dispersants, generally, are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However, they may, interact with ambient metals once they are added to a lubricant which includes a metal-containing species. Ashless dispersants are characterized by a polar group attached to a relatively high molecular weight hydrocarbon chain. Typical ashless dispersants include N-substituted long chain alkenyl succinimides, having a variety of chemical structures, including those represented by Formula (A)

Formula (A)

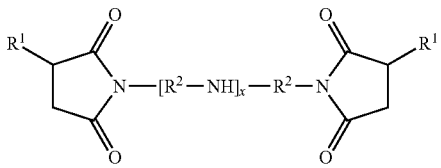

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups.

Such molecules are commonly derived from reaction of an alkenyl acylating agent with a polyamine, and a wide variety of linkages between the two moieties is possible beside the simple imide structure shown above, including a variety of amides and quaternary ammonium salts. In the above Formula (A), the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

In certain embodiments, the dispersant is prepared by a process that involves the presence of small amounts of chlorine or other halogen, as described in U.S. Pat. No. 7,615,521 (see, e.g., col. 4, lines 18-60 and preparative example A). Such dispersants typically have some carbocyclic structures in the attachment of the hydrocarbyl substituent to the acidic or amidic "head" group. In other embodiments, the dispersant is prepared by a thermal process involving an "ene" reaction, without the use of any chlorine or other halogen, as described in U.S. Pat. No. 7,615,521;

dispersants made in this manner are often derived from high vinylidene (i.e. greater than 50% terminal vinylidene) polyisobutylene (See col. 4, line 61 to col. 5, line 30 and preparative example B). Such dispersants typically do not contain the above-described carbocyclic structures at the point of attachment. In certain embodiments, the dispersant is prepared by free radical catalyzed polymerization of high-vinylidene polyisobutylene with an ethylenically unsaturated acylating agent, as described in U.S. Pat. No. 8,067,347.

Some dispersants for use in the instant lubricating compositions may be derived from, as the polyolefin, high vinylidene polyisobutylene, that is, having greater than 50, 70, or 75% terminal vinylidene groups (.alpha. and .beta. isomers). In certain embodiments, the succinimide dispersant may be prepared by the direct alkylation route. In other embodiments it may comprise a mixture of direct alkylation and chlorine-route dispersants.

Suitable dispersants for use in the instant lubricating compositions include succinimide dispersants. In one embodiment, the dispersant may be present as a single dispersant. In one embodiment, the dispersant may be present as a mixture of two or three different dispersants, wherein at least one may be a succinimide dispersant.

The succinimide dispersant may be a derivative of an aliphatic polyamine, or mixtures thereof. The aliphatic polyamine may be aliphatic polyamine such as an ethylenepolyamine, a propylenepolyamine, a butylenepolyamine, or mixtures thereof. In one embodiment, the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from $C_2$-$C_6$ epoxides such as ethylene oxide, propylene oxide, and butylene oxide. Examples of polyether polyamines are sold under the Jeffamine® brand and are commercially available from Hunstman Corporation located in Houston, Texas.

The dispersant may also be post-treated by conventional methods by a reaction with any of a variety of agents. Among these are boron compounds, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds. In one embodiment, the succinimide dispersant may be post-treated with boron, resulting in a borated dispersant. In one embodiment, the succinimide dispersant comprises at least one boron-containing dispersant and at least one boron-free dispersant. In one embodiment, the lubricating composition is free of or substantially free of a boron-containing succinimide dispersant The polyalkenyl succinimide dispersant may be present in an amount of from 1.2 wt % to 4 wt % of the lubricating composition, or 1.5 wt % to 3.8 wt % of the composition, or 0.5 to 4.0, or 0.8 to 3.0, or 1.1 to 2.3, or 1.5 to 2.8 or 1.2 wt % to 3 wt %, or 2.0 wt % to 3.5 wt % of the composition. It is understood that if a mixture of two or more dispersants comprises the succinimide dispersant, each of those dispersants may be independently present in the composition at 0.01 wt % to 4 wt %, or 0.1 wt % to 3.5 wt %, or 0.5 wt % to 3.5 wt %, or 1.0 wt % to 3.0 wt %, or 0.5 wt % to 2.2 wt % of the lubricating composition, with the proviso that the total amount of dispersant is as described above. In one embodiment, the polyalkenyl succinimide dispersant is a polyisobutylene succinimide. In another embodiment, the polyalkenyl succinimide dispersant is a polyisobutylene succinimide and is present in the lubricating composition in an amount of from 1.2 to 4 wt %.

In one embodiment, the polyalkenyl succinimide dispersant above is a boron-containing succinimide dispersant in an amount of from 1.2 to 4 wt % of the lubricating composition or in treat rates described above with regard to the polyalkenyl succinimide dispersant. In another embodiment, the polyalkenyl succinimide dispersant is a mixture of boron-free and boron-containing succinimide dispersants. When both boron-containing dispersants and boron-free dispersants are present, the ratio of the one or more boron-containing dispersants to the one or more boron-free dispersants may be 4:1 to 1:4 on a weight basis, or 3:1 to 1:3, or 2:1 to 1:3, or 1:1 to 1:4 on a weight basis. In another embodiment, one or more boron-containing dispersants is present in an amount 0.8 wt % up to 2.1 wt % and one or more boron-free dispersants is present in an amount 0.8 wt % up to 4 wt % of the lubricating composition.

Anti-Wear Additive:

In one embodiment, the lubricating compositions further comprise an anti-wear agent. Examples of anti-wear agents include phosphorus-containing anti-wear/extreme pressure agents such as metal thiophosphates, phosphoric acid esters and salts thereof, phosphorus-containing carboxylic acids, esters, ethers, and amides, and phosphites. In certain embodiments a phosphorus antiwear agent may be present in an amount to deliver 0.01 to 0.2, or 0.015 to 0.15, or 0.02 to 0.1, or 0.025 to 0.08, or 0.01 to 0.05 percent phosphorus. Often the anti-wear agent is a zinc dialkyldithiophosphate (ZDDP or ZDP).

Zinc dialkyldithiophosphates may be described as primary zinc dialkyldithiophosphates or as secondary zinc dialkyldithiophosphates, depending on the structure of the alcohol used in its preparation. In some embodiments the compositions of the invention include primary zinc dialkyldithiophosphates. In some embodiments the compositions of the invention include secondary zinc dialkyldithiophosphates. In some embodiments the compositions of the invention include a mixture of primary and secondary zinc dialkyldithiophosphates. In some embodiments component (b) is a mixture of primary and secondary zinc dialkyldithiophosphates where the ratio of primary zinc dialkyldithiophosphates to secondary zinc dialkyldithiophosphates (one a weight basis) is at least 1:1, or even at least 1:1.2, or even at least 1:1.5 or 1:2, or 1:10. In some embodiments, component (b) is a mixture of primary and secondary zinc dialkyldithiophosphates that is at least 50 percent by weight primary, or even at least 60, 70, 80, or even 90 percent by weight primary. In some embodiments component (b) is free of primary zinc dialkyldithiophosphates.

The phosphorus anti wear agent may be present at 0.05 wt % to 3 wt %, or 0.08 to 1.3, or 0.08 to 2.1 wt %, or 0.1 wt % to 1.5 wt %, or 0.5 wt % to 0.9 wt % of the lubricating composition.

Antioxidant:

In one embodiment, the lubricating compositions may include an antioxidant, such as an ashless antioxidant. Ashless antioxidants may comprise one or more of arylamines, diarylamines, alkylated arylamines, alkylated diaryl amines, phenols, hindered phenols, sulfurized olefins, or mixtures thereof. In one embodiment the lubricating composition includes an antioxidant, or mixtures thereof. The antioxidant may be present at 0.01 wt % to 5 wt %, or 0.1 wt % to 4 wt %, or 0.2 wt % to 3 wt %, or 0.5 wt % to 2 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment, the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The diarylamine antioxidant of the invention may be present on a weight basis of the lubrication composition at 0.1% to 10%, 0.35% to 5%, 0.4% to 1.2%, or even 0.5% to 2%.

The phenolic antioxidant may be a simple alkyl phenol, a hindered phenol, or coupled phenolic compounds.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, 4-dodecyl-2,6-di-tert-butylphenol, or butyl 3-(3,5-ditert-butyl-4-hydroxyphenyl)propanoate. In one embodiment, the hindered phenol antioxidant may be an ester and may include, e.g., Irganox™ L-135 from BASF. In one embodiment, the phenolic antioxidant comprises a hindered phenol. In another embodiment the hindered phenol is derived from 2,6-ditertbutyl phenol.

In one embodiment, the lubricating composition of the invention comprises a phenolic antioxidant in a range of 0.01 weight % to 5 weight %, or 0.1 weight % to 4 weight %, or 0.2 weight % to 3 weight %, or 0.5 weight % to 2 weight % of the lubricating composition.

Sulfurized olefins are well known commercial materials, and those which are substantially nitrogen-free, that is, not containing nitrogen functionality, are readily available. The olefinic compounds which may be sulfurized are diverse in nature. They contain at least one olefinic double bond, which is defined as a non-aromatic double bond; that is, one connecting two aliphatic carbon atoms. These materials generally have sulfide linkages having 1 to 10 sulfur atoms, for instance, 1 to 4, or 1 or 2.

Ashless antioxidants may be used separately or in combination. In one embodiment of the invention, two or more different antioxidants are used in combination, such that there is at least 0.1 wt % of each of the at least two antioxidants and wherein the combined amount of the ashless antioxidants is 0.5 to 5 wt %. In one embodiment, there may be at least 0.25 to 3 wt % of each ashless antioxidant.

Molybdenum Compound:

In one embodiment, the lubricating compositions described herein may include a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm, or 5 ppm to 300 ppm, or 20 ppm to 250 ppm of molybdenum, or 350 ppm to 900 ppm.

Dispersant Viscosity Modifier:

In one embodiment, the lubricating compositions may further include a dispersant viscosity modifier. The dispersant viscosity modifier may be present at 0 weight % to 5 weight %, or 0 weight % to 4 weight %, or 0.05 weight % to 2 weight % of the lubricating composition.

Suitable dispersant viscosity modifiers include functionalized polyolefins, for example, ethylene-propylene copolymers that have been functionalized with an acylating agent such as maleic anhydride and an amine; polymethacrylates functionalized with an amine, or esterified styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment, the dispersant viscosity modifier may include those described in U.S. Pat. No. 4,863,623 (see column 2, line 15 to column 3, line 52) or in International Publication WO2006/015130 (see page 2, paragraph [0008] and preparative examples are described at paragraphs [0065] to [0073]).

Metal-Based Detergent:

In one embodiment, the lubricating compositions described herein may include a metal-containing detergent. The metal-containing detergent may be an overbased detergent. Overbased detergents otherwise referred to as overbased or superbased salts are characterized by a metal content in excess of that which would be necessary for neutralization according to the stoichiometry of the metal and the particular acidic organic compound reacted with the metal. The overbased detergent may be selected from the group consisting of non-sulfur containing phenates, sulfur containing phenates, sulfonates, salixarates, salicylates, and mixtures thereof.

The overbased metal-containing detergent may be sodium salts, calcium salts, magnesium salts, or mixtures thereof of the phenates, sulfur-containing phenates, sulfonates, salixarates and salicylates. Overbased phenates and salicylates typically have a total base number of 180 to 450 TBN. Overbased sulfonates typically have a total base number of 250 to 600, or 300 to 500. Overbased detergents are known in the art. In one embodiment, the sulfonate detergent may be predominantly a linear alkylbenzene sulfonate detergent having a metal ratio of at least 8 as is described in paragraphs [0026] to [0037] of US Patent Publication 2005065045 (and granted as U.S. Pat. No. 7,407,919). The linear alkylbenzene sulfonate detergent may be particularly useful for assisting in improving fuel economy. The linear alkyl group may be attached to the benzene ring anywhere along the linear chain of the alkyl group, but often in the 2, 3 or 4 position of the linear chain, and in some instances, predominantly in the 2 position, resulting in the linear alkylbenzene sulfonate detergent. Overbased detergents are known in the art. The overbased detergent may be present at 0 weight % to 15 weight %, or 0.2 weight % to 15 weight %, or 0.3 weight % to 10 weight %, or 0.3 weight % to 8 weight %, or 0.4 to 3 weight %, or 0.2 weight % to 3 weight %. For example, in a heavy-duty diesel engine, the detergent may be present at 2 weight % to 3 weight % of the lubricating composition. For a passenger car engine, the detergent may be present at 0.2 weight % to 1 weight % of the lubricating composition.

Metal-containing detergents contribute sulfated ash to a lubricating composition. Sulfated ash may be determined by ASTM D874. In one embodiment, the lubricating composition of the invention comprises a metal-containing detergent in an amount to deliver at least 0.4 wt % sulfated ash to the total composition. In another embodiment, the metal-containing detergent is present in an amount to deliver at least 0.6 wt % sulfated ash, or at least 0.75 wt % sulfated ash, or even at least 0.9 wt % sulfated ash to the lubricating composition.

Polymer Viscosity Modifier:

The lubricating compositions described herein may further contain a polymeric viscosity modifier or mixtures thereof. The polymeric viscosity modifier may be an olefin (co)polymer, a poly(meth)acrylate (PMA), or mixtures thereof. In one embodiment, the polymeric viscosity modifier is an olefin (co)polymer.

The olefin polymer may be derived from isobutylene or isoprene. In one embodiment, the olefin polymer is prepared from ethylene and a higher olefin within the range of C3-C10 alpha-mono-olefins, for example, the olefin polymer may be prepared from ethylene and propylene.

In one embodiment, the olefin polymer may be a polymer of 15 to 80 mole percent of ethylene, for example, 30 mol percent to 70 mol percent ethylene and from and from 20 to 85 mole percent of C3 to C10 mono-olefins, such as propylene, for example, 30 to 70 mol percent propylene or higher mono-olefins. Terpolymer variations of the olefin copolymer may also be used and may contain up to 15 mol percent of a non-conjugated diene or triene. Non-conjugated dienes or trienes may have 5 to about 14 carbon atoms. The non-conjugated diene or triene monomers may be characterized by the presence of a vinyl group in the structure and can include cyclic and bicycle compounds. Representative dienes include 1,4-hexadiene, 1,4-cyclohexadiene, dicyclopentadiene, 5-ethyldiene-2-norbornene, 5-methylene-2-norbornene, 1,5-heptadiene, and 1,6-octadiene.

In one embodiment, the olefin copolymer may be a copolymer of ethylene, propylene, and butylene. The polymer may be prepared by polymerizing a mixture of monomers comprising ethylene, propylene and butylene. These polymers may be referred to as copolymers or terpolymers. The terpolymer may comprise from about 5 mol % to about 20 mol %, or from about 5 mol % to about 10 mol % structural units derived from ethylene; from about 60 mol % to about 90 mol %, or from about 60 mol % to about 75 mol structural units derived from propylene; and from about 5 mol % to about 30 mol %, or from about 15 mol % to about 30 mol % structural units derived from butylene. The butylene may comprise any isomers or mixtures thereof, such as n-butylene, iso-butylene, or a mixture thereof. The butylene may comprise butene-1. Commercial sources of butylene may comprise butene-1 as well as butene-2 and butadiene. The butylene may comprise a mixture of butene-1 and isobutylene wherein the weight ratio of butene-1 to isobutylene is about 1:0.1 or less. The butylene may comprise butene-1 and be free of or essentially free of isobutylene.

In one embodiment, the olefin copolymer may be a copolymer of ethylene and butylene. The polymer may be prepared by polymerizing a mixture of monomers comprising ethylene and butylene wherein, the monomer composition is free of or substantially free of propylene monomers (i.e. contains less than 1 wt % of intentionally added monomer). The copolymer may comprise 30 to 50 mol percent structural units derived from butylene; and from about 50 mol percent to 70 mol percent structural units derived from ethylene. The butylene may comprise a mixture of butene-1 and isobutylene wherein the weight ratio of butene-1 to isobutylene is about 1:0.1 or less. The butylene may comprise butene-1 and be free of or essentially free of isobutylene.

Useful olefin polymers, in particular, ethylene-α-olefin copolymers have a number average molecular weight ranging from 4500 to 500,000, for example, 5000 to 100,000, or 7500 to 60,000, or 8000 to 45,000.

In one embodiment, lubricating composition may comprise a poly(meth)acrylate polymeric viscosity modifier. As used herein, the term "(meth)acrylate" and its cognates means either methacrylate or acrylate, as will be readily understood.

In one embodiment, the poly(meth)acrylate polymer is prepared from a monomer mixture comprising (meth)acrylate monomers having alkyl groups of varying length. The (meth)acrylate monomers may contain alkyl groups that are straight chain or branched chain groups. The alkyl groups may contain 1 to 24 carbon atoms, for example 1 to 20 carbon atoms.

The poly(meth)acrylate polymers described herein are formed from monomers derived from saturated alcohols, such as methyl (meth)acrylate, ethyl (meth)acrylate, propyl (meth)acrylate, butyl (meth)acrylate, 2-methylpentyl (meth) acrylate, 2-propylheptyl (meth)acrylate, 2-butyloctyl (meth) acrylate, 2-ethylhexyl (meth)acrylate, octyl (meth)acrylate, nonyl (meth)acrylate, isooctyl (meth)acrylate, isononyl (meth)acrylate, 2-tert-butylheptyl (meth)acrylate, 3-isopropylheptyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, hexadecyl (meth)acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyl-octadecyl-(meth)acrylate, octadecyl (meth)acrylate, nonadecyl (meth)acrylate, eicosyl (meth)acrylate, (meth)acrylates derived from unsaturated alcohols, such as oleyl (meth)acrylate; and cycloalkyl (meth)acrylates, such as 3-vinyl-2-butylcyclohexyl (meth) acrylate or bornyl (meth)acrylate.

Other examples of monomers include alkyl (meth)acrylates with long-chain alcohol-derived groups which may be obtained, for example, by reaction of a (meth)acrylic acid (by direct esterification) or methyl (meth)acrylate (by transesterification) with long-chain fatty alcohols, in which reaction a mixture of esters such as (meth)acrylate with alcohol groups of various chain lengths is generally obtained. These fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

In one embodiment, the poly(meth)acrylate polymer comprises a dispersant monomer; dispersant monomers include those monomers which may copolymerize with (meth)acrylate monomers and contain one or more heteroatoms in addition to the carbonyl group of the (meth)acrylate. The dispersant monomer may contain a nitrogen-containing group, an oxygen-containing group, or mixtures thereof.

The nitrogen-containing compound may be a (meth) acrylamide or a nitrogen containing (meth)acrylate monomer. Examples of a suitable nitrogen-containing compound include N,N-dimethylacrylamide, N-vinyl carbonamides such as N-vinyl-formamide, vinyl pyridine, N-vinylacetoamide, N-vinyl propionamides, N-vinyl hydroxy-acetoamide, N-vinyl imidazole, N-vinyl pyrrolidinone, N-vinyl caprolactam, dimethylaminoethyl acrylate (DMAEA), dimethylaminoethyl methacrylate (DMAEMA), dimethylaminobutyl acrylamide, dimethylaminopropyl meth-acrylate (DMAPMA), dimethylaminopropyl acrylamide, dimethylaminopropyl methacrylamide, dimethylaminoethyl acrylamide or mixtures thereof.

Dispersant monomers may be present in an amount up to 5 mol percent of the monomer composition of the (meth) acrylate polymer. In one embodiment, the poly(meth)acrylate is present in an amount 0 to 5 mol percent, 0.5 to 4 mol percent, or 0.8 to 3 mol percent of the polymer composition. In one embodiment, the poly(meth)acrylate is free of or substantially free of dispersant monomers.

In one embodiment, the poly(meth)acrylate comprises a block copolymer or tapered block copolymer. Block copolymers are formed from a monomer mixture comprising one or more (meth)acrylate monomers, wherein, for example, a first (meth)acrylate monomer forms a discrete block of the polymer joined to a second discrete block of the polymer formed from a second (meth)acrylate monomer. While block copolymers have substantially discrete blocks formed from the monomers in the monomer mixture, a tapered block copolymer may be composed of, at one end, a relatively pure first monomer and, at the other end, a relatively pure second monomer. The middle of the tapered block copolymer is more of a gradient composition of the two monomers.

In one embodiment, the poly(meth)acrylate polymer (P) is a block or tapered block copolymer that comprises at least one polymer block ($B_1$) that is insoluble or substantially insoluble in the base oil and a second polymer block ($B_2$) that is soluble or substantially soluble in the base oil.

In one embodiment, the poly(meth)acrylate polymers may have an architecture selected from linear, branched, hyperbranched, cross-linked, star (also referred to as "radial"), or combinations thereof. Star or radial refers to multi-armed polymers. Such polymers include (meth)acrylate-containing polymers comprising 3 or more arms or branches, which, in some embodiments, contain at least about 20, or at least 50 or 100 or 200 or 350 or 500 or 1000 carbon atoms. The arms are generally attached to a multivalent organic moiety which acts as a "core" or "coupling agent." The multi-armed polymer may be referred to as a radial or star polymer, or even a "comb" polymer, or a polymer otherwise having multiple arms or branches as described herein.

Linear poly(meth)acrylates, random, block or otherwise, may have weight average molecular weight (Mw) of 1000 to 400,000 Daltons, 1000 to 150,000 Daltons, or 15,000 to 100,000 Daltons. In one embodiment, the poly(meth)acrylate may be a linear block copolymer with a Mw of 5,000 to 40,000 Daltons, or 10,000 to 30,000 Daltons.

Radial, cross-linked or star copolymers may be derived from linear random or di-block copolymers with molecular weights as described above. A star polymer may have a weight average molecular weight of 10,000 to 1,500,000 Daltons, or 40,000 to 1,000,000 Daltons, or 300,000 to 850,000 Daltons.

The lubricating compositions may comprise 0.05 weight % to 2 weight %, or 0.08 weight % to 1.8 weight %, or 0.1 to 1.2 weight % of the one or more polymeric viscosity modifiers as described herein.

Friction Modifier:

In one embodiment, the lubricating composition described herein may further include a friction modifier different than the alkenyl carboxylic acid ester of a diol or polyol friction modifier disclosed herein. Examples of such additional friction modifiers include long chain fatty acid derivatives of amines, fatty esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides. The term fatty, as used herein, can mean having a C8-22 linear alkyl group.

These friction modifiers may also encompass materials such as sulfurized fatty compounds and olefins, molybdenum dialkyldithiophosphates, molybdenum dithiocarbamates, sunflower oil or monoester of a polyol and an aliphatic carboxylic acid.

In one embodiment the additional friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The addition ffriction modifier may be present at 0 weight % to 6 weight %, or 0.05 weight % to 4 weight %, or 0.1 weight % to 2 weight %, or 0.25 weight % to 1 weight % of the lubricating composition.

In one embodiment, the additional friction modifier may be a long chain fatty acid ester. In another embodiment the long chain fatty acid ester may be a mono-ester or a diester or a mixture thereof, and in another embodiment the long chain fatty acid ester may be a triglyceride.

Additional Performance Additives:

Other performance additives such as corrosion inhibitors include those described in paragraphs 5 to 8 of U.S. application Ser. No. 05/038,319, published as WO2006/047486, octyl octanamide, condensation products of dodecenyl succinic acid or anhydride and a fatty acid such as oleic acid with a polyamine may be present in the instant lubricating compositions. In one embodiment, the corrosion inhibitors include the Synalox® (a registered trademark of The Dow Chemical Company) corrosion inhibitor. The Synalox corrosion inhibitor may be a homopolymer or copolymer of propylene oxide. The Synalox. corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

The lubricating composition may further include metal deactivators, including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors, including copolymers of ethyl acrylate and 2-ethylhexylacrylate and copolymers of ethyl acrylate and 2-ethylhexylacrylate and vinyl acetate; demulsifiers including trialkyl phosphates, polyethylene glycols, polyethylene oxides, polypropylene oxides and (ethylene oxide-propylene oxide) polymers; and pour point depressants, including esters of maleic anhydride-styrene, polymethacrylates, polyacrylates or polyacrylamides. Metal deactivators, foam inhibitors, and pourpoint depressants may each independently be present from 0.01 weight % to 1.5 weight %, or 0.025 to 1.0 weight %, or 0.05 to 0.5 weight % of the lubricant composition.

Pour point depressants that may be useful in the compositions of the invention further include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Alkenyl Carboxylic Acid Ester of a Diol or Polyol Friction Modifier | 0.5 to 1.0 | 0.7 to 0.75 | 0.1 to 0.3 |
| Polyalkenyl Succinimide Dispersant | 1.2 to 4 | 1.5 to 3.6 | 2 to 3.4 |
| Anti-wear Agents | 0.15 to 4 | 0.2 to 2 | 0.5 to 1.5 |
| Ashless Antioxidants | 0 to 6 | 0.6 to 3 | 0.8 to 2.5 |
| Metal Detergents | 0 to 5 | 0.45 to 2.5 | 0.8 to 2 |
| Viscosity Modifier | 0 or 0.1 to 4.5 | 0.5 to 3 | 0.8 to 1.8 |
| Dispersant Viscosity Modifier | 0 or 0.1 to 4.5 | 0 or 0.1 to 2.5 | 0.5 to 1.6 |
| Friction Modifier | 0 or 0.05 to 2 | 0.05 to 1.6 | 0.1 to 1.2 |
| Any Other Performance Additive | 0 or 0.05 to 6 | 0 or 0.05 to 3 | 0 or 0.05 to 1.8 |
| Other Oil of Lubricating Viscosity | Balance to 100 % | | |

INDUSTRIAL APPLICATION

The instant alkenyl carboxylic acid ester of a diol or polyol friction modifier can be used in lubricant compositions formulated to lubricant a mechanical device. Such mechanical devices include, without limitation, an internal combustion engine, such as, for example, a spark ignited internal combustion engine or a compression ignition internal combustion engine; and a driveline device, such as, an automatic transmission, manual transmission, dual clutch transmissions, or an axle or differential. The compression ignition internal combustion engine can include a heavy-duty diesel engine.

Diesel engines are classified by their Gross Vehicle Weight Rating (GVWR). The GVWR includes the maximum rated weight of the vehicle and cargo, including passengers. The GVWR is applied to trucks or trailers, but not the two combined, which is a separate rating referred to as the Gross Combined Weight Rating (GCWR). The GVWR's for various classes of diesel engines are set forth in the table below:

| Class | GVWR (lbs) |
|---|---|
| Class 1 | 0-6,000 lbs |
| Class 2 | 6,001-10,000 lbs |
| | (divided into 2 classes Class 2A & 2B, see below) |
| Class 2A | 6,001-8,500 lbs |
| Class 2B | 8,501-10,000 lbs |
| Class 3 | 10,001-14,000 lbs |
| Class 4 | 14,001-16,000 lbs |
| Class 5 | 16,001-19,500 lbs |
| Class 6 | 19,5001-26,000 lbs |
| Class 7 | 26,001-33,000 lbs |
| Class 8 | Over 33,000 lbs |

Light duty vehicles are classified as those falling in Class 1 to 3. Class 2A vehicles are typically called "light duty" and class 2B vehicles are often called "light heavy duty" vehicles.

Medium duty vehicles refer to those falling into Classes 4 to 6. Heavy-Duty vehicles are those classified in Class 7 and Class 8.

Lubricant compositions described herein having the disclosed alkenyl carboxylic acid ester of a diol or polyol friction modifier can be used in lubricants for diesel engines in all of Class 1 through Class 8 engines. In one embodiment, the lubricant compositions are used in Class 8 engines.

A driveline device lubricating composition in different embodiments may have a composition as disclosed in the following table:

| | Embodiments (wt %) | | | |
|---|---|---|---|---|
| Additive | A | B | C | D |
| Alkenyl Carboxylic Acid Ester of a Diol or Polyol Friction Modifier | 0.1 to 5 | 0.2 to 3 | 0.5 to 2.5 | 0.25 to 1.5 |
| Other Dispersant | 1 to 4 | 0.1 to 10, 2 to 7 | 0 to 5 | 1 to 6 |
| Extreme Pressure Agent | 3 to 6 | 0 to 6 | 0 to 3 | 0 to 6 |
| Overbased Detergent | 0 to 1 | 0.01 to 3, 0.025 to 2 | 0.5 to 6 | 0.01 to 2 |
| Antioxidant | 0 to 5 | 0.01 to 10 or 2 | 0 to 3 | 0 to 2 |
| Friction Modifier | 0 to 5 | 0.01 to 5 | 0.1 to 1.5 | 0 to 5 |
| Viscosity Modifier | 0.1 to 70 | 0.1 to 15 | 1 to 60 | 0.1 to 70 |
| Any Other Performance Additive | 0 to 10 | 0 to 8 or 10 | 0 to 6 | 0 to 10 |
| Oil of Lubricating Viscosity | | Balance to 100 % | | |

Footnote:
The viscosity modifier in the table above may also be considered as an alternative to an oil of lubricating viscosity.
Column A may be representative of an automotive or axle gear lubricant.
Column B may be representative of an automatic transmission lubricant.
Column C may be representative of an off-highway lubricant.
Column D may be representative of a manual transmission lubricant.

Unless otherwise stated herein, reference to treat rates or amounts of components present in the lubricating compositions disclosed herein are quoted on an oil free basis, i.e., amount of active.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character including one or more double bonds. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and components within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, or compositions, which can, of course, vary. It is also to be understood that the terminology used herein is for the purpose of describing particular embodiments only and is not intended to be limiting.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure may be described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc.

As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 wt. % refers to groups having 1, 2, or 3 wt. %. Similarly, a group having 1-5 wt. % refers to groups having 1, 2, 3, 4, or 5 wt. %, and so forth, including all points therebetween.

Moreover, where a recited range for a treat rate is provided, it is contemplated that such range shall include treat rates for individual components and/or a mixture of components. Thus, for example, a range of 1 to 3 wt % contemplates that a given component may be present in a range of 1 to 3 wt % or that a mixture of similar components can be present in a range from 1 to 3 wt %.

As used herein, the term "about" means that a value of a given quantity is within +20% of the stated value. In other embodiments, the value is within ±15% of the stated value. In other embodiments, the value is within ±10% of the stated value. In other embodiments, the value is within +5% of the stated value. In other embodiments, the value is within ±2.5% of the stated value. In other embodiments, the value is within ±1% of the stated value.

Unless otherwise stated, "wt %" as used herein shall refer to the weight percent based on the total weight of the composition on an oil-free basis.

EXAMPLES

The following examples provide an illustration of the invention. These examples are non-exhaustive and are not intended to limit the scope of the invention.

A series of glycerol based hydrocarbyl esters were prepared and evaluated for their ability to reduce friction, specifically with respect to glycerol mono-oleate (GMO).

Two different routes to preparative examples H, I and M are described below, the first involves the formation and isolation of orthoesters containing a ketal protected diol and an allylic alcohol, which is isolated. This is then converted (via Johnson-Claisen rearrangement) to a ketal protected alkenyl carboxylic acid ester of a diol or polyol.

The second route to preparative examples H, I involves the synthesis of a mixed solketal orthoester. This is then both reacted with an allylic alcohol to form a new orthoester and then converted (via Johnson-Claisen rearrangement) to a protected ketal of a alkenyl carboxylic acid ester of a diol or polyol.

Route 1

Precursor A
2,2-dimethyl-4-((vinyloxy)methyl)-1,3-dioxolane

To a solution of ethyl vinyl ether (131 mL, 1.37 mol), palladium(II) trifluoroacetate (851 mg, 2.56 mmol), 1,10-phenanthroline (585 mg, 3.25 mmol) and DCM (5.6 M) was added solketal (6.34 mL, 50.99 mmol) and triethylamine (4 drops). The solution was stirred at 25° C. for 18 h. Diethyl ether (150 mL) was added and the solution was filtered through celite and concentrated to dryness by reduced pressure, which was purified by silica gel chromatography, 10% Ether:Hexane, $R_f$=0.3) gave the title compound (3.5 g, 43%) as a yellow liquid.

Precursor B 4,4'-(((2-Bromoethane-1,1-diyl)bis(oxy))bis(methylene))bis(2,2-dimethyl-1,3-dioxolane To a solution of vinyl ether (mmol as stated), solketal (157 μL, 1.26 mmol) and hexane/DCM (0.12 M, 3:1 v/v) was added NBS (224 mg, 1.26 mmol) at 0° C. Then stirred at 25° C. for 16 h. Pentane (20 mL) was added and the reaction mixture was cooled to −50° C. for 30 min. Pentane (150 mL) was added and the reaction mixture was filtered, washed water (2×100 mL), Sat. aq. $NaHCO_3$ (4×250 mL), dried $MgSO_4$ and concentrated to dryness by reduced pressure to yield the title compound (317 mg, 68%) as a yellow liquid.

Precursor C 4,4'-((ethene-1,1-diylbis(oxy))bis(methylene))bis(2,2-dimethyl-1,3-dioxolane)

To a solution of 4,4'-(((2-Bromoethane-1,1-diyl)bis(oxy))bis(methylene))bis(2,2-dimethyl-1,3-dioxolane (1.00 g, 2.71 mmol) and THE (0.14 M), at 0° C., was added KO$^t$Bu (669 mg, 5.96 mmol) portion wise over 30-40 min. The solution was then stirred at the stated temperature for 2 h. Hexane (100 mL) was then added and the solution was concentrated to dryness by reduced pressure. Further hexane (100 mL) was added and the solution was filtered through a small pad of cotton wool before being concentrated to dryness to yield the title compound (630 mg, 81%) as yellow liquid.

Precursor D and E General Procedure:

Precursor D E)-4,4'-(((1-(Dec-2-en-1-yloxy)ethane-1,1-diyl)bis(oxy))bis(methylene))bis(2,2-dimethyl-1,3-dioxolane)

Precursor E 4,4'-(((1-((2-methylenenonyl)oxy)ethane-1,1-diyl)bis(oxy))bis(methylene)) bis(2,2-dimethyl-1,3-dioxolane To the alcohol (0.624 mmol) was added ketene acetal, 4,4'-((ethene-1,1-diylbis(oxy))bis(methylene))bis(2,2-dimethyl-1,3-dioxolane) (0.624 mmol) in $CHCl_3$ (1.5 ml), via syringe pump, over 45 min. The solution was then heated to 60° C. for 2-3 hours before being concentrated to dryness by reduced pressure to yield either precursor D or E. Alcohol used: Precursor D: dec-2-enol, Precursor E: 2-methylenenonan-1-ol Precursor F and G, General Procedure:

Precursor F (2,2-dimethyl-1,3-dioxolan-4-yl)methyl 3-vinyldecanoate

Precursor G (2,2-dimethyl-1,3-dioxolan-4-yl)methyl 4-methyleneundecanoate

The orthoesters (F or G) (0.149 mmol) and xylene (660 μL) was heated to 138° C. for 400 h. DCM (20 mL) was then added and the reaction mixture was washed water (6×50 mL), dried $MgSO_4$ and concentrated to dryness by reduced pressure to yield Precursor F or G at approximately 71% yield as a yellow liquid.

For the preparation of examples H and I the following general procedure was followed:

Preparative Example H—2,3-dihydroxypropyl 3-vinyldecanoate [244933]

Preparative Example I—2,3-dihydroxypropyl 4-methyleneundecanoate [244950]

To a solution of precursor G or H (0.800 mmol) in IPA (6.8 mL) was added 1M HCl (1.6 mL, 1.60 mmol). The solution was then heated to 50° C. for 2 h. Diethyl ether (20 mL) was added and the solution was washed brine (40 mL), dried $MgSO_4$ and concentrated to dryness by reduced pressure. The crude ester product may be optionally purified by column chromatography (50% EtOAc:Hexane, $R_f$=approx. 0.11) to yield the title compound H or I (approx. 55% or greater yield) as a thick yellow liquid.

Route 2

In one embodiment, the examples of H, I and M can be made using a more direct route. This utilizes a mixed solketal orthoester. Additionally, this route merges the formation of the orthoester and the rearrangement of that ester into a single process, this is described below.

Precursor J, Mixed Solketal Orthoester:

Solketal (124 mL, 996 mmol), trimethyl orthoacetate (21.0 mL, 166 mmol), xylene (286 mL) and TFA (137 μL, 1.66 mmol) at 80° C. for 24 h. The crude orthoester was then washed water (6×200 mL), dried $MgSO_4$ and concentrated to dryness. Purification by distillation (110° C., 0 mbar) gave a mixture of mono-, di- and tri-substituted solketal orthoester (14.1 g) as a colourless liquid.

Precursor F, G and K, General Procedure:

Note: This procedure describes both the orthoester formation and rearrangement of that to examples F, G and K in a single process.

Precursor F (2,2-dimethyl-1,3-dioxolan-4-yl)methyl 3-vinyldecanoate

Precursor G (2,2-dimethyl-1,3-dioxolan-4-yl)methyl 4-methyleneundecanoate

Precursor K (2,2-dimethyl-1,3-dioxolan-4-yl)methyl (E)-dodec-4-enoate

To the alcohol (6.39 mmol), xylene (45 mL) and solketal orthoester (4.00 g, 12.8 mmol) was added propionic acid (144 μL, 1.93 mmol). The solution was heated to 138° C. for 24 h. EtOAc (100 mL) was then added and the solution was washed 0.5 HCl (6×100 mL), sat. aq. $NaHCO_3$ (100 mL), brine (100 mL), dried $MgSO_4$ and concentrated to dryness (150-170° C., 0 mbar). The crude ester was then purified by column chromatography (10% EtOAc:Hexane, $R_f$=~0.3) to yield examples F, G and K as a yellow liquid greater than 7% yield. Alcohol used: Precursor F: dec-3-enol, Precursor G: 2-methylenenonan-1-ol, Precursor K: decen-3-ol.

For the preparation of examples H, I and M, the following general procedure was followed:

Preparative Example H—2,3-dihydroxypropyl 3-vinyldecanoate [244933]

Preparative Example I—2,3-dihydroxypropyl 4-methyleneundecanoate [244950]

Preparative Example M—2,3-dihydroxypropyl (E)-dodec-4-enoate [244949]

To a solution of precursor B, C or D (0.800 mmol) in IPA (6.8 mL) was added 1M HCl (1.6 mL, 1.60 mmol). The solution was then heated to 50° C. for 2 h. Diethyl ether (20 mL) was added and the solution was washed brine (40 mL), dried $MgSO_4$ and concentrated to dryness by reduced pressure. The crude ester product may be optionally purified by column chromatography (50% EtOAc:Hexane, $R_f$=approx. 0.11) to yield examples H, I or M (approx. 55% or greater yield) as a thick yellow liquid.

Lubricating Compositions

A series of OW-20 lubricant compositions were prepared with the various friction modifiers of the invention. The formulations for testing were prepared by blending a fully formulated oil, containing conventional crankcase additives such as ashless polyisobutenylsuccinimide dispersant, overbased alkaline earth metal detergent, zinc dialkyl dithiophosphate (ZDDP), ashless antioxidant, polymeric viscosity modifiers, and other common additives (TABLE 1), to which the various friction modifiers were top-treated. Elemental analysis and viscometrics were determined for the master blend (EX1).

TABLE 1

Lubricant Compositions[1]

| | EX1 | EX2 | EX3 | EX4 | EX5 |
|---|---|---|---|---|---|
| Group III Base Oil | Balance to 100% | | | | |
| Succinimide Dispersant[2] | 3.4 | 3.4 | 3.4 | 3.4 | 3.4 |
| Overbased Mg Sulfonate[3] | 0.42 | 0.42 | 0.42 | 0.42 | 0.42 |
| Overbased Ca Salicylate[4] | 1.12 | 1.12 | 1.12 | 1.12 | 1.12 |
| ZDDP[5] | 0.18 | 0.18 | 0.18 | 0.18 | 0.18 |
| Ashless Antioxidant[6] | 1.3 | 1.3 | 1.3 | 1.3 | 1.3 |
| Propoxylated Alkylphenol | 2.0 | 2.0 | 2.0 | 2.0 | 2.0 |
| Styrene Butadiene VI Improver | 0.55 | 0.55 | 0.55 | 0.55 | 0.55 |
| Other Additives[7] | 0.21 | 0.21 | 0.21 | 0.21 | 0.21 |
| Glycerol mono-oleate | | 2 | | | |
| Prep H | | | 2 | | |
| Prep I | | | | 2 | |
| Prep M | | | | | 2 |
| Calcium (ppm) | 1220 | | | | |
| Magnesium (ppm) | 710 | | | | |
| Phosphorus (ppm) | 200 | | | | |
| Zinc (ppm) | 230 | | | | |
| Sulfur (ppm) | 1300 | | | | |
| Kinematic Viscosity at 100° C. (ASTM D445) | 8.28 | | | | |
| HTHS (ASTM D4683) | 2.65 | | | | |

[1]All concentrations are oil fee unless otherwise indicated

[2]Polyisobutenyl succinimide derived from high vinylidene PIB (TBN 26 mg KOH/g)

[3]Magnesium overbased alkylbenzene sulfonate detergent (TBN 690 mg KOH/g; 16.2 wt % Mg)

[4]Calcium overbased alkylsalicylate detergent (TBN 300 mg KOH/g; 11 wt % Ca)

[5]C3/C6 mixed secondary zinc dialkyl dithiophosphate

[6]Combination of alkylated diarylamine and sulfurized olefin antioxidants

[7]Other additives include pourpoint depressant and foam inhibitor

Testing

The frictional properties of the compounds of the invention was evaluated in a high frequency reciprocating rig (HFRR). The HFRR is a standard steel ball on hardened steel disk, operated isothermally with a load of 200 g and a stroke frequency of 20 Hz. Coefficient of friction, wear scar and contact potential are measured for each sample (Table 2).

Other bench and performance tests are also used to investigate the impact of additives on the performance of the lubricant composition; these tests include hot tube testing for deposit control, pressure differential scanning calorimetry (PDSC; ACEA L-85-99) to evaluate oxidation control, MHT TEOST (ASTM D7097) to evaluate deposit formation.

Hot tube testing is a lubrication industry bench test that measures the degree of high temperature detergency and thermal and oxidative stability of a lubricating oil. During the test, a specified amount of test oil is pumped upwards through a glass tube that is placed inside an oven set at a certain temperature. Air is introduced in the oil stream before the oil enters the glass tube and flows upward with the oil. Evaluations of the lubricating oils were conducted at 280° C. After cooling and washing, the test result is determined by comparing the amount of lacquer deposited on the glass test tube to a rating scale ranging from 1.0 (very black) to 10.0 (perfectly clean). The result is reported in multiples of 0.5.

TABLE 2

| Performance Testing | | | | | |
|---|---|---|---|---|---|
| | EX1 | EX2 | EX3 | EX4 | EX5 |
| Coefficient of friction (ave) | | 0.122 | 0.140 | 0.130 | 0.121 |
| Time 1 (0-30 min) | | 0.121 | 0.142 | 0.137 | 0.130 |
| Time 2 (30-60 min) | | 0.123 | 0.137 | 0.123 | 0.111 |
| Time 3 (45-60 min) | | 0.124 | 0.137 | 0.124 | 0.110 |
| End of Test | | 0.124 | 0.137 | 0.115 | 0.110 |
| PDSC (L-85-99) Induction Time (minutes) | 85 | | | | |
| Hot Tube Rating (280° C.) | 8.5 | | | | |

As the results show, replacement of conventional glycerol mono-oleate with glycerol ester friction modifiers of the invention results in lower dynamic friction at the end of an extended test period.

What is claimed is:

1. A lubricating composition comprising:

an oil of lubricating viscosity;

an alkenyl carboxylic acid ester of an aliphatic diol represented by the formula:

(III)

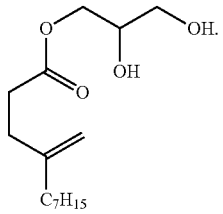

2. The composition of claim 1, wherein the alkenyl carboxylic acid ester of an aliphatic diol is present in the lubricating composition in an amount 0.05 to 3 wt % of the composition.

3. The composition of claim 1, further comprising a polyisobutenyl succinimide dispersant in an amount of from 0.5 to 4.0 weight percent of the composition.

4. The composition of claim 1, further comprising an alkaline earth metal detergent in an amount of from 0.2 wt % to 15 wt % of the composition.

5. The composition of claim 1, further comprising an antiwear agent in an amount of from 0.05 wt % to 3 wt % of the composition.

6. The composition of claim 5, wherein the antiwear agent is a zinc dialkyldithiophosphate.

7. The composition of claim 1, further comprising an antioxidant in an amount of from 0.01 wt % to 5 wt % of the composition.

* * * * *